US006955746B2

(12) United States Patent
Yule

(10) Patent No.: US 6,955,746 B2
(45) Date of Patent: Oct. 18, 2005

(54) CORROSION-INHIBITED SYSTEM AND METHOD FOR PROVIDING A UTILITY SERVICE TO A PLURALITY OF CONSUMERS

(76) Inventor: Jim Yule, 4505-49 Street, St. Paul, Alberta (CA) T0A 3A3

( * ) Notice: Subject to any disclaimer, the term of this patent is extended or adjusted under 35 U.S.C. 154(b) by 519 days.

(21) Appl. No.: 10/306,385

(22) Filed: Nov. 27, 2002

(65) Prior Publication Data

US 2004/0099539 A1 May 27, 2004

(51) Int. Cl.[7] ..... C23F 13/00

(52) U.S. Cl. ..... 204/196.37; 204/196.09; 204/196.21; 204/196.36; 205/734; 205/740; 205/726; 205/727

(58) Field of Search ..... 204/196.09, 196.21, 204/196.36, 196.37; 205/726, 727, 734, 740

(56) References Cited

U.S. PATENT DOCUMENTS

| | | | | |
|---|---|---|---|---|
| 1,962,696 | A | | 6/1934 | Rhodes |
| 2,053,214 | A | | 9/1936 | Brown |
| 2,127,315 | A | | 8/1938 | Thayer |
| 2,556,089 | A | | 6/1951 | James et al. |
| 2,846,385 | A | | 8/1958 | Buchan |
| 3,445,370 | A | | 5/1969 | Sherman |
| 3,448,034 | A | | 6/1969 | Craft et al. |
| 3,603,956 | A | | 9/1971 | Byerley et al. |
| 3,825,866 | A | * | 7/1974 | Piccione ..... 337/17 |
| 3,930,977 | A | * | 1/1976 | Wood ..... 204/196.06 |
| 4,752,368 | A | * | 6/1988 | Wasson ..... 205/724 |
| 5,006,214 | A | | 4/1991 | Burchnell et al. |
| 5,466,353 | A | * | 11/1995 | Westermann et al. .. 204/196.02 |
| 6,224,742 | B1 | * | 5/2001 | Doniguian ..... 205/724 |
| 6,506,295 | B1 | * | 1/2003 | Takahashi et al. ..... 205/725 |

OTHER PUBLICATIONS

"Cathodic Protection Information Base," website: www.pateyles.btinternet.co.uk/home.htm, 6 pages (undated).

Tutorial for "Cathodic Protection Information Base," website: www.pateyles.btinternet.co.uk/tutorial.htm, 16 pages (undated).

* cited by examiner

*Primary Examiner*—Bruce F. Bell
(74) *Attorney, Agent, or Firm*—Leydig, Voit & Mayer, Ltd.

(57) ABSTRACT

A corrosion-inhibited system for providing a utility service to a plurality of consumers includes a plurality of metallic utility service structures, each utility service structure having components buried in a common electrolyte and electrically connected to each other through an electrical utility service connected to an electric utility supply common to each of the consumers in the plurality of consumers. The system further includes a single protection apparatus including at least one anode in physical contact with the common electrolyte. The system further includes a conductor physically connecting the single protection apparatus to only one of the utility service structures.

23 Claims, 2 Drawing Sheets

CORROSION-INHIBITED SYSTEM AND METHOD FOR PROVIDING A UTILITY SERVICE TO A PLURALITY OF CONSUMERS

BACKGROUND OF THE INVENTION

1. Field of Invention

This invention relates to corrosion-inhibited systems and methods for providing a utility service to a plurality of consumers and more particularly to corrosion protection for utility services.

2. Description of Related Art

Systems for providing a utility service such as water to a plurality of consumers often include a plurality of metallic water supply structures associated with respective consumers in a residential neighborhood or subdivision or industrial complex, for example. These structures may include copper water pipes and metallic fittings such as clamps and valves buried in the ground.

Normally, the metallic water supply structures would be connected to a metallic watermain made of steel, iron or cast iron, for example, and such watermain may be equipped with an integral anode in direct connection with the watermain to prevent corrosion of the watermain. The metal of the watermain is less noble than copper feeder pipes normally used to supply consumers from the watermain and thus the watermain is more anodic than the copper feeder pipes and provides cathodic protection to those copper pipes. The integral anode on the metallic watermain is normally made of Zinc or Magnesium or a Magnesium alloy and is thus more anodic than the metal of the watermain. Consequently, the anode protects the watermain from corrosion and the watermain and the anode together provide cathodic protection from corrosion to the copper feeder pipes.

The anodes on existing metallic watermains need periodic replacement which often requires expensive excavation. In addition, many existing metallic watermains are coming to the end of their useful life and are being replaced with plastic pipe. New installations also often use plastic pipe watermains.

With the increasing use of plastic watermains, the remaining water supply structures are left with virtually no anodes and are subject to corrosion as a result. The present invention addresses this problem.

SUMMARY OF THE INVENTION

In accordance with one aspect of the invention, there is provided a corrosion-inhibited system for providing a utility service to a plurality of consumers. The system includes a plurality of metallic utility service structures, each utility service structure having components buried in a common electrolyte and electrically connected to each other through an electrical utility service connected to an electrical utility supply common to each of the consumers in the plurality of consumers. The system further includes a single protection apparatus including at least one anode in physical contact with the common electrolyte, and a conductor physically connecting the single protection apparatus to only one of the utility service structures. In a residential housing environment or industrial complex, since all of the metallic utility service structures are electrically connected to each other through an electrical utility service common to each of the consumers and since all the metallic utility service structures are buried in the ground, which acts as a common electrolyte, only a single protection apparatus is required to provide corrosion protection to all of the metallic utility service structures associated with buildings served by the same electrical supply. Thus, the conventional need to separately provide corrosion protection to respective underground metallic utility service structures is eliminated.

The single protection apparatus may be sized or its composition varied to cause a pre-determined electrical potential to occur between the single protection apparatus and the conductor physically connecting the single protection apparatus to the metallic utility service structure to ensure adequate corrosion protection will occur.

The system may include a test post having first and second terminals electrically isolated from the electrolyte. The first portion of the conductor connecting the protection apparatus to the metallic utility service structure may be connected to the first terminal and the second portion of the conductor may be connected to the second terminal. The pre-determined electric potential may be measured between the first and second terminals.

The system may further include a connector operable to electrically connect the first terminal to the second terminal.

The single protection apparatus may include a single anode formed of a material less noble than materials forming the metallic utility service structures components buried in the common electrolyte. Alternatively, the single protection apparatus may include a plurality of anodes connected to only one of the utility service structures.

The utility service provided to the consumers may be a water utility service and said conductor connecting the protection apparatus to the metallic utility service structure may be connected to a component of the water utility service such as a waterpipe or a watermeter associated with the water utility service.

The common electrolyte may include land on which buildings of the consumers of the utility services are situate.

In accordance with another aspect of the invention, there is provided an apparatus for simultaneously corrosion-protecting a plurality of metallic utility service structures supplying respective consumers, where at least part of each utility service structure is buried in an electrolyte and where a conductor of an electrical utility service connected to an electric utility supply common to the plurality of consumers is connected to the metallic utility service structure. The apparatus includes a single protection apparatus comprised of an anode made of a metal less noble than metallic components of the utility service structure in physical contact with the electrolyte and a first conductor electrically connecting the single protection apparatus to only one of the metallic utility service structures.

In accordance with another aspect of the invention, there is provided a method of providing a utility service to a plurality of consumers while protecting the utility service from corrosion. The method involves supplying the utility service to the plurality of consumers through a plurality of respective metallic utility service structures, each respective utility service structure having components buried in a common electrolyte and electrically connected to each other through an electrical utility service connected to an electric utility supply common to each of the consumers, and physically connecting directly to only one of the utility service structures a single protection apparatus including at least one anode in physical contact with the common electrolyte.

Connecting the single protection apparatus to the utility service structure may involve connecting a conductor between the single protection apparatus and only one of the utility service structures.

The method may involve connecting a first portion of the conductor between the single protection apparatus and a first terminal of a test post and connecting a second portion of the first conductor between a second terminal of the test post and only one of the utility service structures.

The method may involve measuring a potential between the first and second terminals and connecting the first and second terminals together when the potential is greater than a pre-determined value.

The method may involve connecting at least one more anode to the single protection apparatus when the potential is less than a pre-determined value. Alternatively the composition of the anode may be changed.

The utility service provided to the consumers may be a water utility service and connecting the single protection apparatus to the utility service structure may involve connecting the anode apparatus to a component of a structure associated with the water utility service.

In one embodiment, connecting may involve connecting the anode apparatus to a waterpipe associated with the water utility service and in another embodiment, connecting may involve connecting the anode apparatus to a water meter associated with the water utility service.

In accordance with another aspect of the invention, there is provided a method of simultaneously protecting a plurality of metallic water supply structures buried in the ground and supplying respective consumers from a non-metallic watermain, and which are electrically connected to a conductor of an electrical utility service connected to an electric utility supply common to the respective consumers. The method involves connecting a single protection apparatus comprised of an anode including a metal less noble than metallic components of the metallic water supply structures and which is in physical contact with the ground, by a first electrical conductor physically connected to only one of the plurality of metallic water supply structures.

In accordance with another aspect of the invention, there is provided an apparatus for providing a utility service to a plurality of consumers while protecting the utility service from corrosion. The method involves provisions for supplying the utility service to the plurality of consumers through a plurality of respective utility service structures, each respective utility service structure having components buried in a common electrolyte and electrically connected to each other through an electrical utility service connected to an electric utility supply common to each of the consumers in the plurality of consumers, and provisions for physically connecting a single protection apparatus including at least one anode in physical contact with the common electrolyte directly to only one of the utility service structures.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
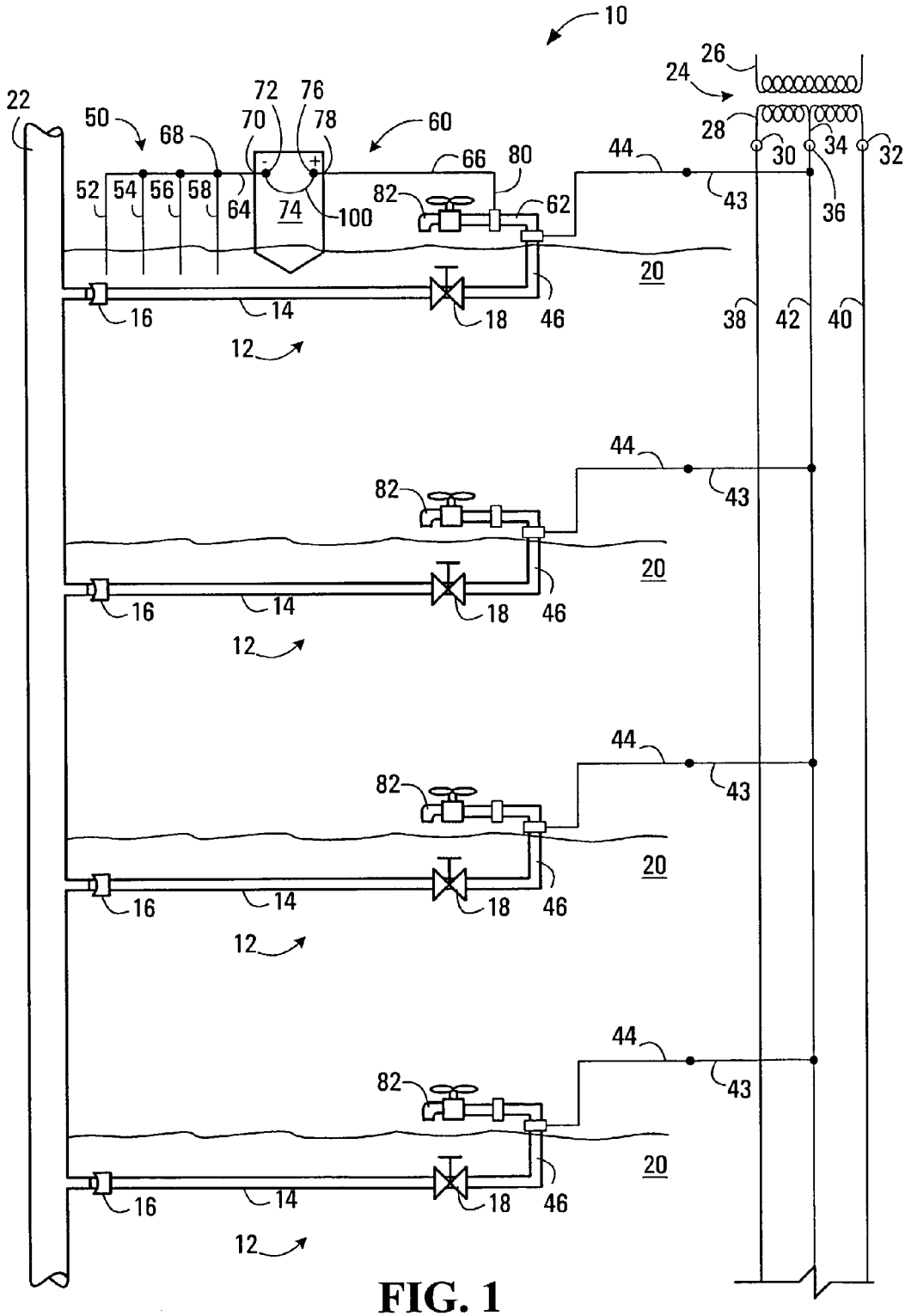
FIG. 1 is a schematic representation of a corrosion-inhibited system for providing a utility service to a plurality of consumers, according to a first embodiment of the invention.

Referring to FIG. 1, a corrosion inhibited system for providing a utility service to a plurality of consumers is shown generally at 10. The utility service may be any utility service that involves the use of metallic components buried in a common electrolyte. In the embodiment shown, the system 10 includes a plurality of metallic water supply structures 12, which include copper water pipes 14 and metallic fittings such as clamps 16 and valves 18, for example, buried in the ground 20. These components of a water utility service supply respective consumer buildings with water from a common plastic watermain 22. In this embodiment the electrolyte includes the ground 20 that is associated with respective consumer or industrial buildings.

Each of the consumer buildings is also connected to a common electrical utility supply 24 in a conventional manner. An electrical utility supply typically includes a transformer 26 having a center-tapped secondary winding 28. Opposite ends 30 and 32 of the secondary winding 28 act as line 1 and line 2 terminals that provide AC voltages 180 degrees out of phase with each other relative to a center tap 34, which acts as a neutral terminal 36. Wires 38, 40 and 42 are connected to extend from each of the line 1 and line 2 terminals 30, 32 and a neutral wire 42 is connected to extend from the neutral terminal 36 to each consumer building within a subdivision, for example, to supply electrical power to each building. These wires are commonly referred to as an electrical utility service or just electrical service. Thus, each consumer in the subdivision is supplied with electrical power by electrical services connected to a common electrical utility supply.

As is conventional, at each building a wire 43 connected to the neutral wire 42 is usually terminated in an electrical distribution box and is electrically connected by a stranded "ground" wire 44 of about 10 gauge in size, for example, to a waterpipe 46 of the water supply structure 12 that supplies the corresponding building with water. Use of this stranded ground wire 44 acts to locally "ground" the neutral wire 42 at the consumer's building to establish a zero voltage reference at the building. Since each consumer building normally employs this method of grounding the electrical service at the building, the buried water supply structures 12 are connected to each other through respective neutral wires 43 connected to the neutral wire 42 terminating at the neutral terminal 36 of the secondary winding 28 of the transformer 26. In effect, the water supply structures 12 act like a plurality of metallic probes immersed in a common electrolyte (the ground 20) and electrically connected together through respective neutral wires 43 of the electrical utility service to the associated building.

From the foregoing, it will be appreciated that in the embodiment shown, the copper pipes 14 and related components (16 and 18) act as means for supplying the utility service to a plurality of consumers through a plurality of respective water supply structures 12, where each respective utility service structure has components (14, 16 and 18) buried in a common electrolyte (the ground 20) and electrically connected to each other through an electrical utility service provided by an electrical utility supply common to each of the consumers in the plurality of consumers.

The system further includes a single protection apparatus 50 including at least one anode 52 comprised of a metal less noble than the metallic components of the water supply structure 12 and in electrical contact with the common electrolyte (the ground 20) and further includes a first conductor 60, physically connecting the single protection apparatus to only one of the water supply structures 12. The anode apparatus 50 may comprise the single anode 52 or a plurality of anodes 52, 54, 56 and 58 all connected to each other or individually connected to the same water supply structure 12. Generally, each of the anodes is situated in relatively close proximity to each other.

In one embodiment, anodes 52, 54, 56 and 58 may be separate, individual "packaged" anodes. A single packaged anode is made by supporting an approximately 24 lb. zinc slug having a generally square cross section, a width of about 1.25 inches and a length of about 40 inches inside a closed bottom end of a hollow cardboard cylinder having a diameter of approximately 3 to 5 inches and a length of about 46 inches. The length of the cardboard cylinder is selected to be generally the same as the depth beneath the surface of the ground at which the metallic components of the utility service to be protected are located. The slug is supported generally coincident with an axis of the hollow cardboard tube. A #8 stranded wire is integrally molded into the anode and is arranged to extend out of an opposite end of the cardboard cylinder. This wire forms part of a first conductor 60 that is used to electrically connect the anode apparatus to the utility service structure to be protected.

A powder formed of a mixture comprised of approximately 20% Bentonite™, 75% Gypsum and 5% Sodium Suphate is tamped into the hollow cardboard cylinder to act as an interface between the slug and the cardboard cylinder. The cylinder is closed at both ends.

The slug may be formed of Magnesium, Magnesium Alloys, Zinc, Aluminum 25, Cadmium, or Aluminum 17ST, for example, to protect steel or iron components of the water supply structure 12 buried in the ground 20. Zinc has been found to work particularly well and is generally preferred over magnesium as magnesium tends to deplete faster than zinc in the application described herein when used in soil conditions such as found in Macklin, Saskatchewan, Canada. A suitable zinc slug for use in forming the anodes of the type described herein is available from Canada Metals of Calgary Alberta, Canada.

One or more packaged anodes of the type described above may be used as the single protection apparatus.

Generally it is contemplated that all of the anodes (52–58) forming the single protection apparatus 50 will be grouped together in relatively close proximity to each other, perhaps within one meter of each other, and will be situated near only one of the buildings supplied by the same electrical utility supply. Each anode is inserted into its own hole in the ground, which may measure 6 to 8 inches in diameter, for example, and 12 feet deep, for example, the depth being desirably generally the depth at which the metallic utility service structures are buried. The hole is filled with water before the anode is inserted therein to help decrease the resistance of the interface between the anode and the ground. Separate anodes associated with each building are not required. The number of anodes (52–58) required to act as the single protection apparatus 50 will depend on the surface area of all of the buried water supply structures 12, the soil resistivity, the resistance of the buried metallic water supply structures 12, the resistance of the first conductor 60 connecting the single protection apparatus to the metallic structure, the resistance of the anodes, the resistance of the interface between the anodes and the soil, the resistance of the interface between the metallic water supply structure 12 and the soil, the surface area of the anodes and the material used in the anodes. Many of these factors cannot be controlled accurately and may change with environmental conditions.

A simple way of determining an appropriate number of anodes may involve inserting anodes into the ground 20 and connecting them to each other as shown in the drawings, until a potential difference of some pre-determined value is measured between the protection apparatus 50 and the one metallic water supply structure 12 to which it will be connected. This may be done over a period of time, where, for example, a first anode may be installed and potential difference measurements taken over the course of a year to determine a lowest reading. If the lowest reading is not above the threshold, a second anode is installed. This process may be repeated over the course of a number of years. In Macklin, Saskatchewan, Canada, a potential difference of about 100 m VDC is an appropriate pre-determined difference value. Thus, the single protection apparatus is designed to cause a pre-determined electrical potential to occur between the single protection apparatus and the conductor.

In the embodiment shown, the first conductor 60 electrically connects the single protection apparatus 50 to an unburied portion 62 of only one of the metallic water supply structures 12. Generally, the first conductor 60 comprises first and second portions 64 and 66. The first portion 64 has a first end 68 that is electrically connected to the single protection apparatus 50, above the ground 20. The first portion also has a second end 70 that is routed into a test post 74. As suitable test post may be made by securing a length of plastic conduit to a plastic electrical box. The conduit and plastic electrical box may be secured to a 4×4 treated spruce post firmly planted in the ground, for example. The electrical box is fitted with a terminal strip having a first terminal 72 to which the second end 70 is connected and a second terminal 76 adjacent the first terminal 72, to which a first end 78 of the second portion 66 of the first conductor 60 is connected. Both the first and second terminals 72 and 76 of the test post 74 are electrically isolated from the ground 20. A second end 80 of the second portion 66 of the first conductor 60 is connected to the unburied portion 62 of the metallic water supply structure 12 associated with the building adjacent to where the single protection apparatus 50 is installed in the ground 20. Portions 64 and 66 of the first conductor may be buried in the ground and routed through the length of plastic conduit, which may have one end also buried in the ground to receive these portions. Desirably, the second portion 66 is insulated.

In the embodiment shown in FIG. 1, the component of the water utility service to which the protection apparatus 50 is connected includes a metallic water distribution pipe such as a copper waterpipe associated with the water utility service. More particularly, the second end 80 of the second portion 66 of the first conductor 60 may be connected to or adjacent a hose bib 82 on the unburied portion 62, for example.

Figure 2:
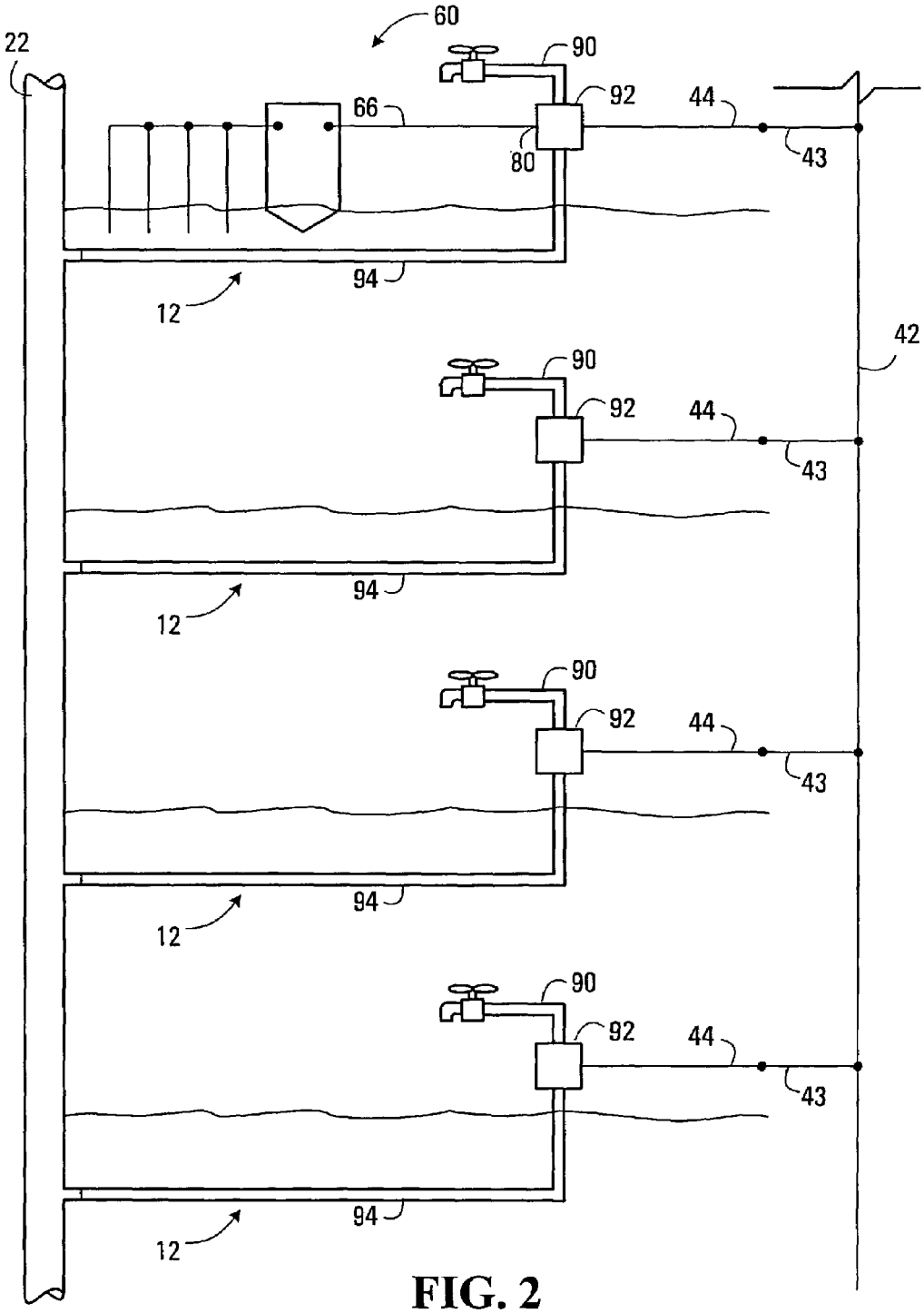
FIG. 2 is a schematic representation of a corrosion inhibited system for providing a utility service to a plurality of consumers, according to a second embodiment of the invention.

Referring to FIG. 2, in an alternative embodiment where plastic pipes 90 instead of copper pipes are used to distribute water within the building, the water system includes a water meter 92 at each building which is fed by a respective copper pipe 94 extending from the plastic watermain. Typically water meters 92 of the type described herein have a metal casing to which the copper pipe 94 extending from the plastic watermain 22 is soldered. This forms an electrical connection between the copper pipe 94 and the water meter 92 and thus, the second end 80 of the second portion 66 of the first conductor 60 may be connected directly to the water meter. Similarly, the water meter 92 may be electrically connected to the neutral wire 42 of the electric utility supply by the ground wire 44 and the neutral wire 43 of the electric utility service.

Referring to FIGS. 1 and 2, the hose bib 82, metallic water distribution pipes such as the unburied portion 62 and/or water meter 92 act as various alternative means for physically connecting a single protection apparatus 50 including at least one anode 52 in physical contact with the common electrolyte (the ground 20) directly to only one of the water supply structures 12.

Referring back to FIG. 1, the first and second terminals 72 and 76 facilitate easy measurement of the potential between the anode protection 50 and the metallic water supply structure 12. For example, a voltmeter (not shown) may be connected between the first and second terminals 72 and 76 and additional anodes may be set in the ground 20 near the existing anodes (52–58) as described above and may be electrically connected to the existing anodes until the measured voltage between the first and second terminals exceeds the pre-determined value. When the voltage exceeds the predetermined value, the voltmeter may be removed and a connector 100, such as a jumper wire, may be connected across the first and second terminals 72 and 76 to connect the terminals together, thereby ultimately connecting the protection apparatus 50 to the metallic water supply structure 12 at a single physical point.

In effect, with the water supply structures 12 acting like a plurality of metallic probes immersed in a common electrolyte (the ground 20) once the protection apparatus 50 is connected to only one of the water supply structures 12, it is automatically connected to all of the other structures through the electric utility services to each building. The electric circuit so formed permits the protection apparatus 50 to inhibit corrosion of all metallic structures that are less noble than the anodes in the protection apparatus 50 and thus the single protection apparatus is able to provide corrosion protection to all water utility structures supplying water to buildings which receive electric power from the common electrical utility supply 24. A single protection apparatus 50 may, for example, provide corrosion protection to perhaps twenty water utility structures, thereby eliminating the conventional practice of separately providing corrosion protection for each individual water utility structure.

While specific embodiments of the invention have been described and illustrated, such embodiments should be considered illustrative of the invention only and not as limiting the invention as construed in accordance with the accompanying claims.

What is claimed is:

1. A corrosion-inhibited system for providing a utility service to a plurality of consumers, the system comprising:

a plurality of metallic utility service structures, each utility service structure having components buried in a common electrolyte and electrically connected to each other through an electrical utility service connected to an electrical utility supply common to each of said consumers;

a single protection apparatus including at least one anode in physical contact with said common electrolyte; and a conductor connecting said single protection apparatus to only one of said utility service structures.

2. The system of claim 1 wherein said single protection apparatus is operable to cause a pre-determined electrical potential to occur between said single protection apparatus and said conductor.

3. The system of claim 2 wherein said conductor comprises first and second portions.

4. The system of claim 3 further comprising a test post, said test post having first and second terminals electrically isolated from said electrolyte, said first portion of said conductor being connected to said first terminal and said second portion of said conductor being connected to said second terminal, said pre-determined electric potential being measurable between said first and second terminals.

5. The system of claim 4 further comprising a connector operable to electrically connect said first terminal to said second terminal.

6. The system of claim 1 wherein said single protection apparatus comprises a single anode.

7. The system of claim 6 wherein said single anode is formed of a material less noble than materials forming said components buried in said common electrolyte.

8. The system of claim 1 wherein said single protection apparatus comprises a plurality of anodes connected to said only one of said utility service structures.

9. The system of claim 1 wherein the utility service provided to said consumers is a water utility service and wherein said conductor is connected to a component of said water utility service.

10. The system of claim 9 wherein said component of said water utility service includes a waterpipe associated with said water utility service.

11. The system of claim 1 wherein said component of said water utility service includes a water meter associated with said water utility service.

12. The system of claim 1 wherein said common electrolyte includes land on which buildings of said consumers are situate.

13. An apparatus for simultaneously corrosion-protecting a plurality of metallic utility service structures supplying respective consumers of said utility, where at least part of each utility service structure is buried in an electrolyte and where a conductor of an electrical utility service connected to an electric utility supply common to said plurality of consumers is connected to each said metallic utility service structure, the apparatus comprising:

a single protection apparatus comprised of a metal less noble than metallic components of said utility service structure and in physical contact with said electrolyte; and a first conductor electrically connecting said single protection apparatus to only one of said metallic utility service structures.

14. A method of providing a utility service to a plurality of consumers while protecting said utility service from corrosion, the method comprising;

supplying said utility service to said plurality of consumers through a plurality of respective utility service structures, each respective utility service structure having components buried in a common electrolyte and electrically connected to each other through an electrical utility service connected to an electric utility supply common to each of said consumers; and physically connecting directly to only one of said utility service structures a single protection apparatus including at least one anode in physical contact with said common electrolyte.

15. The method of claim 14 wherein connecting comprises connecting a conductor between said single protection apparatus and said only one of said utility service structures.

16. The method of claim 15 further comprising connecting a first portion of said conductor between said single protection apparatus and a first terminal of a test post and connecting a second portion of said first conductor between a second terminal of said test post and said only one of said utility service structures.

17. The method of claim 16 further comprising measuring a potential between said first and second terminals and connecting said first and second terminals together when said potential is greater than a pre-determined value.

18. The method of claim 17 further comprising connecting at least one more anode to said single protection apparatus when said potential is less than a pre-determined value.

19. The method of claim 14 wherein the utility service provided to said consumers is a water utility service and wherein connecting comprises connecting said anode apparatus to a component of a structure associated with said water utility service.

20. The method of claim 19 wherein connecting comprises connecting said anode apparatus to a waterpipe associated with said water utility service.

21. The method of claim 19 wherein connecting comprises connecting said anode apparatus to a watermeter associated with said water utility service.

22. A method of simultaneously protecting a plurality of metallic water supply structures buried in the ground and supplying respective consumers from a non-metallic watermain, and which are electrically connected to a conductor of an electrical utility service connected to an electric utility supply common to said respective consumers, the method comprising:

connecting a single protection apparatus comprised of an anode including metal less noble than metallic components of said metallic water supply structures and which is in physical contact with the ground, by a first electrical conductor physically connected to only one of said plurality of metallic water supply structures.

23. An apparatus for providing a utility service to a plurality of consumers while protecting said utility service from corrosion, the method comprising;

means for supplying said utility service to said plurality of consumers through a plurality of respective utility service structures, each respective utility service structure having components buried in a common electrolyte and electrically connected to each other through an electrical utility service connected to an electrical utility supply common to each of said consumers; and means for physically connecting a single protection apparatus including at least one anode in physical contact with said common electrolyte directly to only one of said utility service structures.

* * * * *